US009809363B2

(12) United States Patent
Glinert et al.

(10) Patent No.: US 9,809,363 B2
(45) Date of Patent: Nov. 7, 2017

(54) PRESENTATION PACKAGING

(71) Applicant: Multi Packaging Solutions, Inc., Lansing, MI (US)

(72) Inventors: Kenneth Glinert, Chappaqua, NY (US); Rick Vulgamott, Brighton, MI (US)

(73) Assignee: MULTI PACKAGING SOLUTIONS, INC., Lansing, MI (US)

( * ) Notice: Subject to any disclaimer, the term of this patent is extended or adjusted under 35 U.S.C. 154(b) by 0 days.

(21) Appl. No.: 15/026,367

(22) PCT Filed: Oct. 7, 2014

(86) PCT No.: PCT/US2014/059441

§ 371 (c)(1),
(2) Date: Mar. 31, 2016

(87) PCT Pub. No.: WO2015/054211

PCT Pub. Date: Apr. 16, 2015

(65) Prior Publication Data

US 2016/0236839 A1 Aug. 18, 2016

Related U.S. Application Data

(60) Provisional application No. 61/887,505, filed on Oct. 7, 2013.

(51) Int. Cl.
*B65D 65/18* (2006.01)
*B65D 6/00* (2006.01)
(Continued)

(52) U.S. Cl.
CPC ..... *B65D 65/18* (2013.01); *B65D 5/02* (2013.01); *B65D 5/441* (2013.01); *B65D 5/5206* (2013.01);
(Continued)

(58) Field of Classification Search
CPC ..... A24F 15/12; B65D 5/02; B65D 5/441; B65D 5/5206; B65D 6/00; B65D 8/00;
(Continued)

(56) References Cited

U.S. PATENT DOCUMENTS 1,620,197 A * 3/1927 Evans ..... B65D 5/5253 206/733
1,646,902 A * 10/1927 Diebold ..... A47F 3/145 206/761
2,767,832 A * 10/1956 Silberman ..... A24F 15/12 206/730
(Continued)

FOREIGN PATENT DOCUMENTS

GB 2181410 A * 4/1987 ..... B65D 5/12

OTHER PUBLICATIONS

Search Report and Written Opinion for International Application No. PCT/US2014/059441, dated Mar. 15, 2015.
(Continued)

*Primary Examiner* — Bryon Gehman
(74) *Attorney, Agent, or Firm* — The Dobrusin Law Firm, P.C.

(57) ABSTRACT

A packaging assembly comprising a base or pedestal portion (36) and a top portion (10) including a plurality of foldable panels (12, 14, 16) and flaps (18, 20, 22, 24, 26, 28) and one or more rigid cap portions (30*a*, 30*b*).

20 Claims, 4 Drawing Sheets

(51) Int. Cl.

| | |
|---|---|
| ***B65D 8/00*** | (2006.01) |
| ***B65D 5/02*** | (2006.01) |
| ***B65D 5/44*** | (2006.01) |
| ***B65D 5/52*** | (2006.01) |
| ***B65D 59/04*** | (2006.01) |
| ***B65D 59/08*** | (2006.01) |

(52) U.S. Cl.
CPC ..... *B65D 11/10* (2013.01); *B65D 15/22* (2013.01); *B65D 59/04* (2013.01); *B65D 59/08* (2013.01); *B65D 2301/20* (2013.01)

(58) Field of Classification Search
CPC ..... B65D 11/10; B65D 15/22; B65D 25/54; B65D 43/16; B65D 59/04; B65D 59/08; B65D 65/18; B65D 85/18; B65D 2301/20
USPC ..... 206/730–774
See application file for complete search history.

(56) References Cited

U.S. PATENT DOCUMENTS

| | | | | |
|---|---|---|---|---|
| 4,574,947 | A * | 3/1986 | Hutchings ..... | B65D 21/0237 220/505 |
| 6,520,339 | B1 * | 2/2003 | Conway, Jr. ..... | B65D 25/54 206/730 |
| 7,243,800 | B1 * | 7/2007 | Feibelman ..... | B65D 5/4204 206/775 |
| 2009/0056274 | A1 * | 3/2009 | Lee ..... | B65D 75/322 206/769 |
| 2009/0057174 | A1 * | 3/2009 | Cesario, Jr. ..... | B65D 15/22 206/278 |

OTHER PUBLICATIONS

International Preliminary Report on Patentability for International Application No. PCT/US2014/059441, dated Feb. 11, 2016.

* cited by examiner

PRESENTATION PACKAGING

FIELD OF THE INVENTION

The present teachings relate generally to packaging containers, and more specifically to container assemblies that includes a base and a preferably transparent folded blank for enclosing and displaying an item within the packaging

BACKGROUND OF THE INVENTION

Currently in the market, there are two approaches for transparent packaging that utilizes a pedestal with a transparent top viewing portion. One is traditionally referred to as a jewel box and includes a plexiglass top, and a rigid chip board base. The other utilizes a plastic folding carton top with and a rigid bottom, generally comprising paper board (e.g, SBS). The jewel box approach is costly and not a sustainable solution. The appearance of the plastic folding carton is not desirable as tucks, flaps, and glue lines are all visible after assembly. It would thus be desirable to provide a transparent pedestal packaging that is both inexpensive and recyclable and avoids the appearance of tucks, flaps and glue lines.

SUMMARY OF THE INVENTION

The container assemblies according to the teachings herein solve one or more of, or even all of the aforementioned needs by employing a scored piece that is locked in with two small molded side caps (which may be injection molded or vacuum formed). The scored piece may be a plastic piece and may preferably be a recyclable material which may be an amorphous polyethylene terephthalate (APET) material. The combination of the scored plastic piece and molded side caps results in a top portion for a pedestal packaging that is both robust and substantially free of any visible tucks, flaps or glue lines. Further, the piece can ship completely flat and be assembled to final shape post-shipping. Because of the way the resulting top portion is paired to the base portion (e.g. pedestal portion) in combination with the molded caps on the ends, it provides a desirable stiffness to the packaging by allowing viewing and handling while protecting the package contents.

One aspect of the teachings herein is directed to a container assembly comprising an upper portion including a scored plastic piece, wherein the scored plastic piece can be assembled to form a three-dimensional shape and one or more side caps, wherein the scored plastic piece is locked in shape with the one or more side caps. The upper portion may be substantially free of any visible tucks, flaps, or glue lines. The container assembly may further comprise a base portion, wherein an area of the base portion receives the upper portion to connect the upper portion and the base portion.

It is contemplated that any of the following, or combination thereof, may also be present within an embodiment of the present invention. In one embodiment, the scored plastic piece may include a center panel and a first side panel and a second side panel. The first and second side panels may be located on opposing sides of the center panel. The center panel may include two end flaps located on opposite ends of the center panel. The first side panel may include two end flaps located on opposite ends of the first side panel, and the second side panel may include two end flaps located on opposite ends of the second side panel. The upper portion may be formed by folding each end flap of the center panel downward and folding the end flaps of each end of the panels inward toward each other and overlapping each of the end flaps on each end. It is contemplated that the upper portion further comprises side caps having an upward panel and a base panel, the upward panel being located in a substantially parallel and overlying relationship with the end flaps of the center panel and the first side panel and second side panel.

In this or another embodiment, it is contemplated that the center panel may lie substantially parallel to the area of the base portion that receives the upper portion. The base portion may have a substantially similar footprint shape as the upper portion. It is also contemplated that the scored plastic piece comprises an amorphous polyethylene terephthalate material. The one or more side caps may be molded. The one or more side caps may be formed by injection molding or vacuum forming. The upward panel of the one or more molded side caps may include raised side edges, a raised end edge for receiving the upper portion, or both. The upward panel may further include one or more indentations for assisting in connecting or removing the side cap portions.

It is also contemplated that one or more corners of free ends of the upper portion may be rounded or sharp. The scored plastic piece may include includes regions having creases, regions having slits, regions having perforations, or a combination thereof. It is contemplated that the perforations may be located along only a portion of a crease. It is also contemplated that the upper portion may comprise two or more scored plastic pieces. The upper portion, the base portion, or both, may further comprise one or more support features, which may ensure that side panels are maintained in a generally orthogonal orientation relative to the base portion, that adjacent side panels are maintained in a generally orthogonal orientation relative to each other, or both. It is also contemplated that the upper portion, the base portion or both may further comprise a paperboard material. The upper portion, the base portion, or both may comprise an opaque material. The upper portion, the base portion, or both may comprise a translucent or transparent material. The upper portion may comprise a translucent or transparent material and the base portion may comprise an opaque material. An item may be releasably connected to the base portion. An item may be releasably connected to the base portion and may be viewed through a translucent or transparent upper portion.

The packaging described herein provides a simple, sustainable, and elegant solution for packages intended to both contain and display. Assembly of the package is simple, the materials are preferably recyclable, and the package is both sturdy and pleasing to the eye.

DETAILED DESCRIPTION

Figure 1:
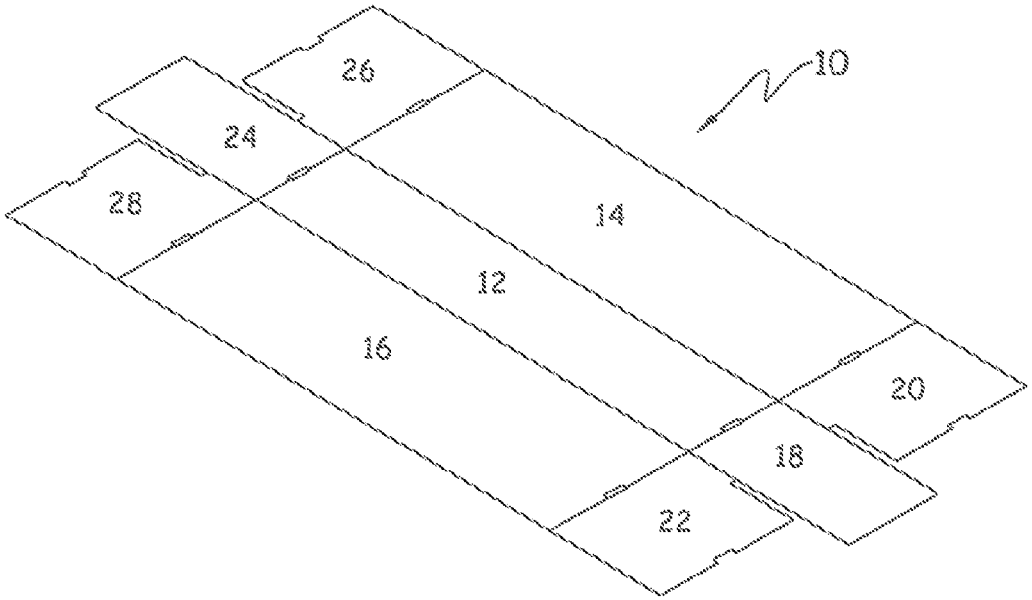
FIG. 1 is a perspective view of an illustrative top portion of a packaging prior to assembly in accordance with the present teachings.

This application claims the benefit of the filing date of U.S. Provisional Application Ser. No. 61/887,505 filed Oct. 7, 2013, the contents of this application being hereby incorporated by reference for all purposes.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The packaging described herein includes a base adapted for receiving an item and a top portion or cover portion for being located onto the base and over an item located on the base. The base and top portion may have similar shapes for forming the appearance of a single integrally formed package, or may be shaped differently. The top portion may be provided with a support means for maintaining the structural integrity of the top portion of the packaging. These support means may be side caps which may be formed of a more rigid material than the remainder of the top portion. The top portion may include one side cap, two side caps, three side caps or more.

The packaging or portions of the packaging may start in a substantially flat format. The flat format may include at least three distinct flat portions including the top portion and two side cap portions. Alternatively, a single integrally formed flat piece may include the top portion and side cap portions. The top portion may be assembled in a substantially rectangular format or may be formed into any three dimensional shape for receiving an item. The top portion may be formed of a polymeric material or may be formed of a paperboard-based material. The side caps may be formed separately from the top portion or may be integrally formed with the top portion. The side caps may be formed separately from one another or be formed as a single integrally formed side cap device that extends to cover one or more ends of the top portion. It is possible that the entire packaging may be formed from one integrally formed piece.

The base portion may be formed as a single flat blank that can be folded to form a three dimensional base portion. Alternatively, the base portion may be pre-formed as a three-dimensional base portion. The base portion may include a variety of connector means. The base portion may include a means for receiving and connecting with the top portion. Such means may include a channel, an edge, a divot, an opening, an extension, an adhesive or any other suitable means maintaining connection between the top portion, the side caps, and the base portion upon assembly. The base portion may also include a means for releasably attaching an item to the base portion (which may be any item offered for sale within the packaging). The means may include an opening, a platform, a trough, an adhesive, a mechanical fastener (e.g., a screw, a tie, a snap, a protrusion, a pin or any combination thereof).

The side caps may be formed with means for receiving and connecting to the top portion, the base portion, or both. Such means may include a channel, an edge, a divot, an opening, an extension, an adhesive or any other suitable means maintaining connection between the side caps and one or more of the base portion and top portion. The side caps may also be formed with means for assembling the side caps onto the top portion and/or base portion. Such means may include tabs, snaps, rivets, openings or any combination thereof.

It is preferable that one or more of the connecting means addressed herein are not visible or are minimally visible upon assembly of the packaging. One or more portions of the packaging may be transparent or translucent. The side caps may be transparent or translucent, or may alternatively be formed from opaque materials. The base portion may be opaque, or may alternatively be transparent or translucent. The top portion may be transparent or translucent. It is possible that only a portion of the top portion is transparent or translucent, while another portion of the top portion is opaque. The top portion may preferably be formed to allow prospective customers to view an item located within the packaging without having to remove the item from the packaging. The packaging may be sufficiently sturdy for holding collectable items after purchase.

As shown for example in FIG. 1, the packaging assembly includes a top portion 10 having a center panel 12 and two side panels 14, 16 each located on opposing sides of the center panel and adjacent with the center panel. The center panel includes two end flaps 18, 24 located on opposite ends of the center panel. Each of the side panels 14, 16 also include two end flaps 20, 26 and 22, 28 respectively.

Figure 2:
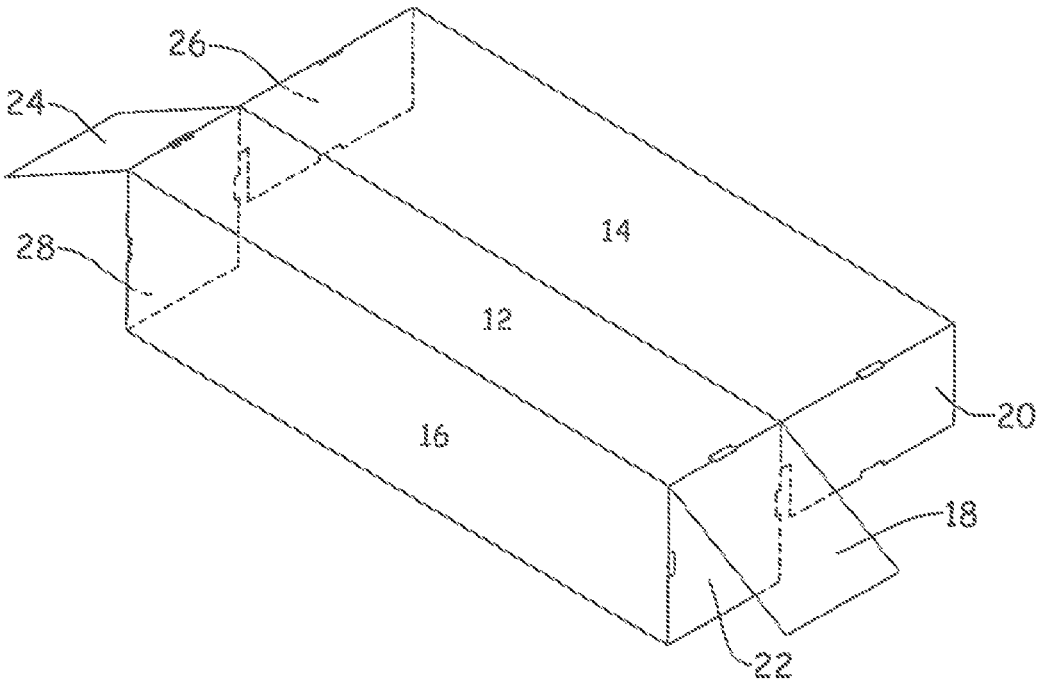
FIG. 2 is a perspective view of partially assembled top portion of FIG. 1.

FIG. 2 depicts the top portion during partial assembly, whereby each side panel is 14, 16 is folded downward from the center panel 12 (side panel 14 is shown prior to downward folding). Each end flap of the center panel 18, 24 is folded downward as well. The end flaps of the side panels 20, 22, 26, 28 are folded downward prior to folding the side panels such that they fold inward toward each other (end flap 20 toward end flap 22 and end flap 26 toward end flap 28) once the side panels are folded downward. The assembly further results in overlap of each of the end flaps such that end flaps 18, 20 and 22 all overlap upon assembly and 24, 26, and 28 all overlap during assembly.

Figure 3:
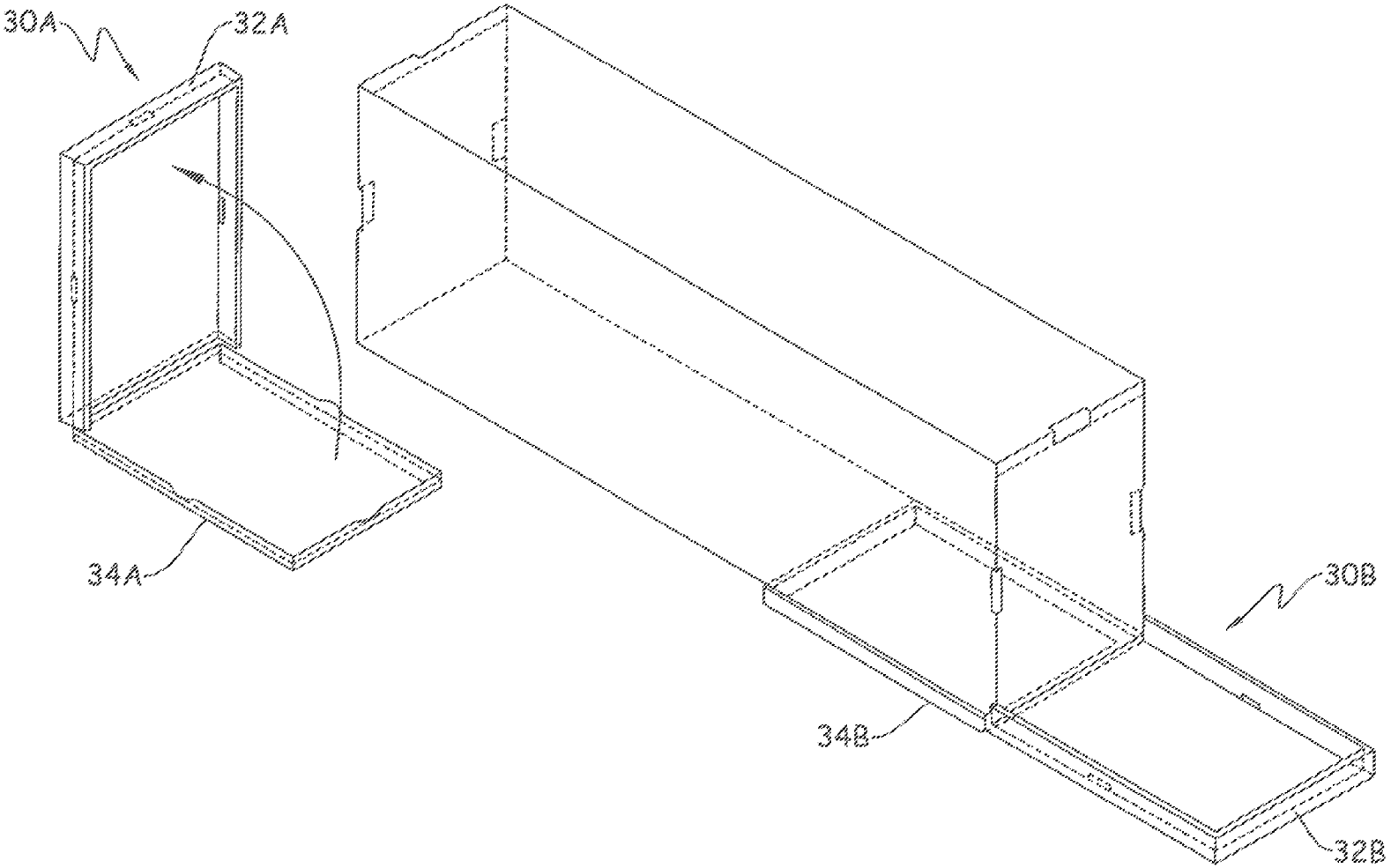
FIG. 3 is a perspective view showing the addition of illustrative cap portions during assembly of the top portion of FIG. 1.

FIG. 3 shows each cap portion 30*a*, 30*b* being connected to the top portion. Each cap portion includes an upward panel 32*a*, 32*b* and a base panel 34*a*, 34*b* such that upon assembly, the upward panel is substantially perpendicular to its associated base panel. Upon attachment of the cap portions, each upward panel 32*a*, 32*b* will be located in a substantially parallel and overlying relationship with the end flaps 18, 20, 22 and 24, 26, 28 respectively.

Figure 4:
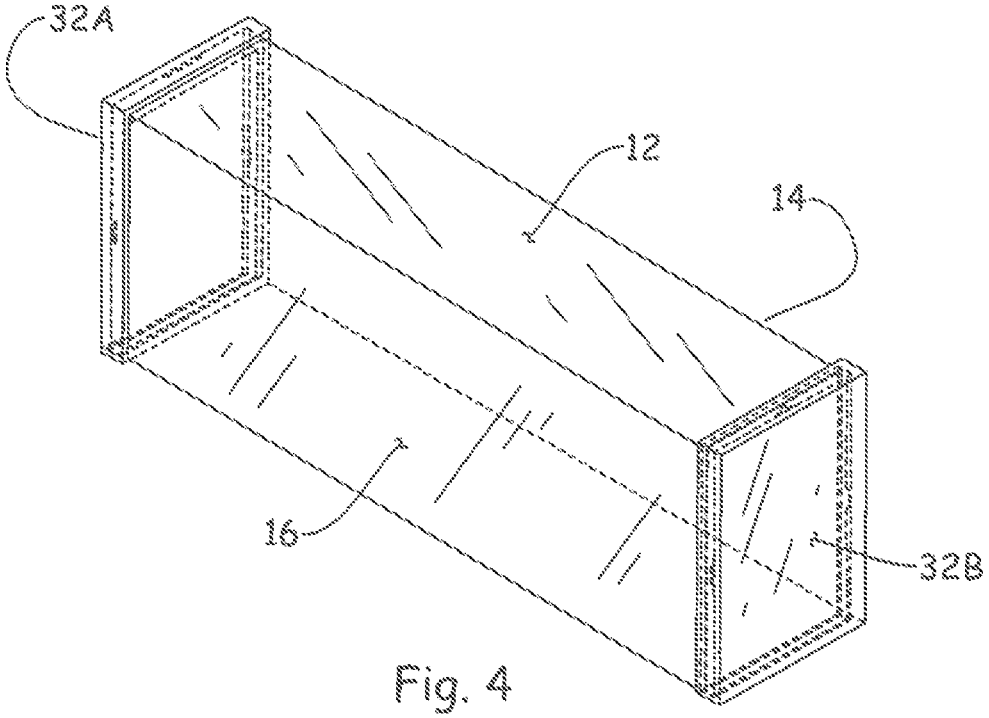
FIG. 4 is a perspective view of an assembled top portion of FIG. 1.
Figure 5:
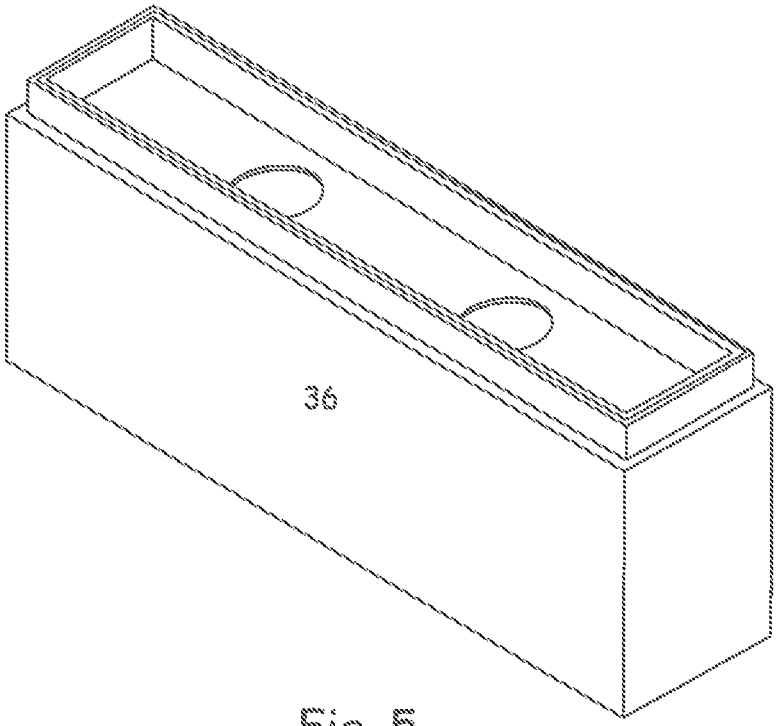
FIG. 5 is a perspective view of an illustrative base portion in accordance with the present teachings.
Figure 6:
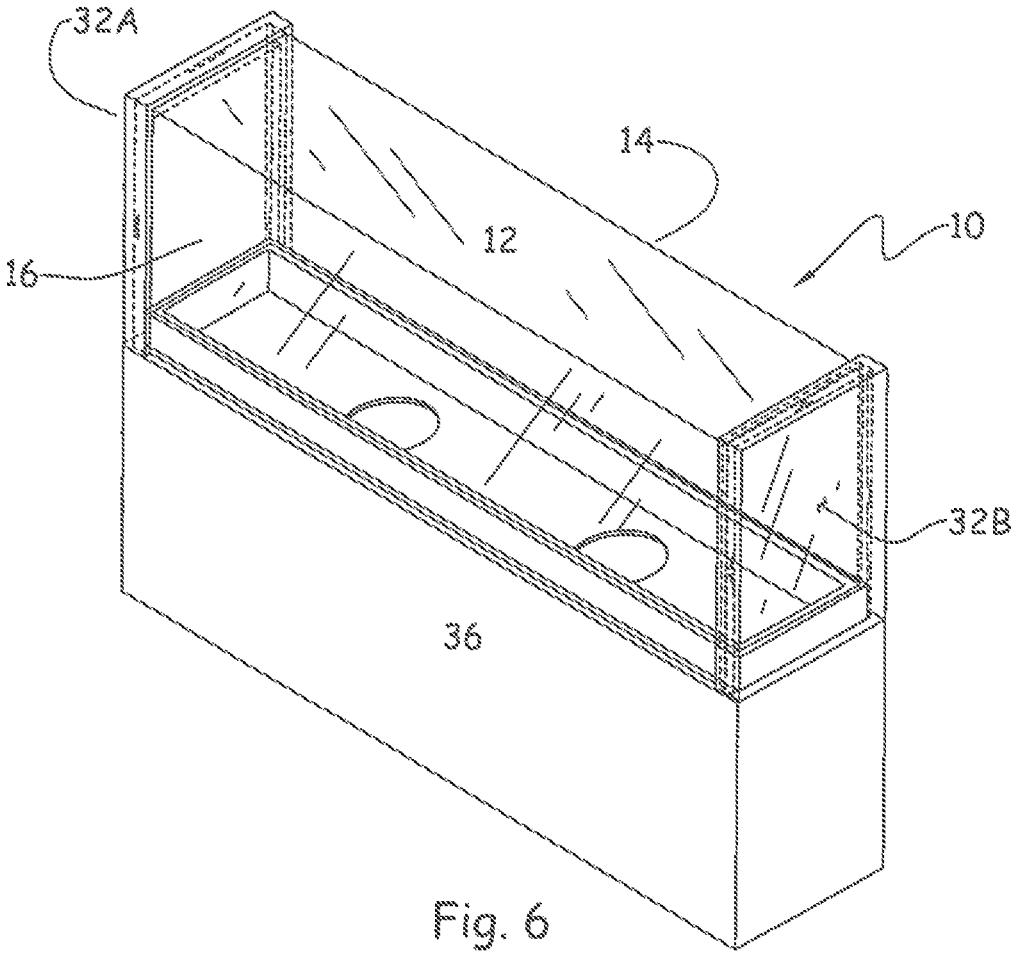
FIG. 6 is a perspective view of a fully assembled top portion and base portion in accordance with the present teachings.

FIG. 4 shows the fully assembled top portion including the cap portions and their upward panels 32*a*, 32*b* located on each external end flap. FIG. 5 shows an exemplary base portion 36. FIG. 5 shows the top portion 10 connected to the base portion such that the center panel 12 lies substantially parallel to the area of the base portion 36 that receives the top portion 10.

Figure 7:
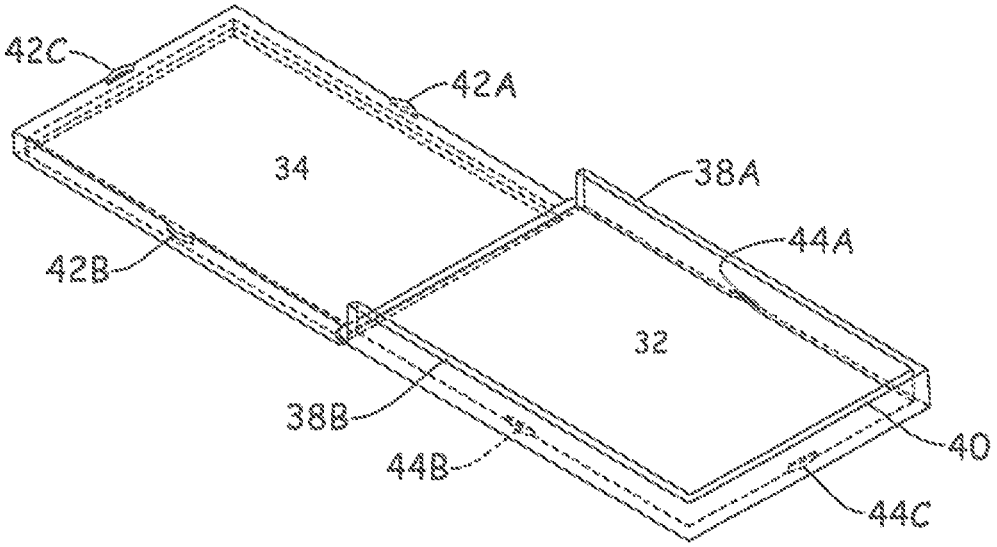
FIG. 7 is a perspective view of an illustrative cap portion in accordance with the present teachings.

FIG. 7 shows a more detailed view of the cap portions 30*a*, 30*b*. The cap portion includes an upward panel 32 and a base panel 34. The upward panel includes raised side edges 38*a*, 38*b* and a raised end edge 40 for receiving the end of the top portion (not shown). The upward panel may also include one or more indentations 44*a*, 44*b*, 44*c* for assisting in connection to and/or removal of the cap portions, such as with protrusions 42*a*, 42*b*, 42*c*. The base panel 34 may include one or more small protrusions for maintaining the cap portions in association with the top portion.

The creases and/or scores depicted in the drawings may include perforations, or may be free of perforations. These may be located as depicted in the drawings or moved. Additional scores, creases and perforations may be may be added. Perforations may be omitted, or may be located intermittently or substantially entirely along a crease. For example, perforations may be located along only a portion of a crease (e.g., a total length of slit material being about 90% or less, about 60% or less, about 40% or less, about 20% or less, or about 10% or less).

Any of the various components of the container assembly may be formed from a single continuous sheet, or from one or more sheets. For example, any of the top portion, base portion or side caps may be formed of a first sheet that provides a structure to the component and a second sheet may be used that covers some or all of the first sheet. As such, a second sheet may provide an aesthetic appearance to the component. A component of the packaging assembly may include sufficient support features, such as side wall connection features so that one or more of the side walls are maintained in a generally orthogonal orientation relative to the base portion, so that adjacent side walls are maintained in a generally orthogonal orientation relative to each other, or both. For example the packaging may include a sufficient number of support features so that the base portion and any pair of adjacent side walls are generally mutually orthogonal.

A sheet (i.e., a blank) for a component or element of the packaging may be formed by die cutting a sheet stock material. As such, the single continuous sheet may be a die cut preform for any of the packaging assembly components. Any material suitable for folding, die cutting, or both may be employed. The sheet material may be a single layered material or may have multiple layers. For example the sheet may include a layer of a polymer, a layer of a paper, or both. A particularly preferred material is a paperboard. Any paperboard may be employed. The sheet material preferably has a thickness that is sufficiently low so that the sheet can be easily folded, the cut, or both. The thickness of the sheet material preferably is about 2 mm or less, more preferably about 1.5 mm or less, even more preferably about 1.2 mm or less, even more preferably about 1.0 mm or less and most preferably about 0.8 mm or less. The thickness of the sheet material preferably is sufficiently high so that the container can be assembled without having to fold an excessive number of layer (e.g., for forming a base). The thickness of the sheet material preferably is about 0.1 mm or more, more preferably about 0.2 mm or more, even more preferably about 0.25 mm or more, even more preferably about 0.30 mm or more, and most preferably about 0.35 mm or more. For example, the sheet material may be a paperboard characterized as about 8 point, 10 point, about 12 point, about 14 point, about 16 point, about 18 point, about 20 point, about 22 point, about 24 point, or about 26 point, about 28 point, about 30 point, or about 32 point.

The blanks for forming the packaging may include regions having creases, regions having slits, regions having perforations, or any combination thereof. Creases preferably are employed in areas that provide a structural feature, such as a connection between two adjacent side walls. Creases are also preferably employed to allow easy folding, defined folding, or both in regions that will be visible in the assembled container. Preferably, the assembled container is free of visible slits or perforations. Perforations and/or slits preferably are employed for folding in regions that are not visible in the assembled container and may not be required to provide a structure between the areas on either side of the fold.

The packaging assemblies according to the teachings herein may be configured to receive one or more items for retail packaging purposes, for displaying purposes, for storage purposes, for transportation purposes, or any combination thereof. For example the container may be configured for receiving an electronic device (such as a consumer electronic device), a cosmetic, a perfume, a bonus gift, a key chain, jewelry, a kit, an article of clothing, a houseware item, an automotive accessory, paper goods, a food item, or any combination thereof. The container assemblies according to the teachings herein may be used for a single-use packaging, or a multiple-use packaging.

Though not necessarily drawn to scale, geometries, relative proportions and dimensions shown in the drawings are also part of the teachings herein, even if not explicitly recited. However, unless otherwise stated, nothing shall limit the teachings herein to the geometries, relative proportions and dimensions shown in the drawing.

The teachings herein contemplate the structures and features depicted in the accompanying drawings. Variations to the structures and features are also contemplated within the teachings. For example, any dimensions, angles, tolerances and/or proportions shown in the drawings are part of the teachings herein. Departures from the dimensions, angles, tolerances and/or relative proportions shown in the drawings are part of the teachings herein to the extent that such variations do not materially affect the intended operation or functionality of the depicted structures and features. For example, variations in an amount of less than 50%, 30% or 10% are envisioned; variations in an amount of more than 50%, 30% or 10% are also envisioned.

Unless otherwise stated or reasonably apparent from the context of the teachings, geometries may vary from those depicted in the drawings. Sharp corners at free ends of the structures may be rounded. Rounded corners at free ends of structures may be sharp.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

What is claimed is:

1. A packaging assembly comprising:

i. an upper portion comprising:

a. a scored plastic piece;

wherein the scored plastic piece can be assembled to form a three-dimensional shape;

b. one or more caps each located at an end of the three-dimensional shape;

wherein a structural integrity of the three-dimensional shape is maintained with the one or more caps;

wherein the upper portion is substantially free of any visible tucks, flaps, or glue lines; and ii. a base portion;

wherein an area of the base portion receives the upper portion.

2. The packaging assembly of claim 1, wherein the scored plastic piece includes a center panel and a first side panel and a second side panel, the first and second side panels located on opposing sides of the center panel.

3. The packaging assembly of claim 2, wherein the center panel includes two end flaps located on opposite ends of the center panel, the first side panel includes two end flaps located on opposite ends of the first side panel, and the second side panel includes two end flaps located on opposite ends of the second side panel.

4. The packaging assembly of claim 3, wherein the upper portion is formed by folding each end flap of the center panel downward and folding the end flaps of one end of the first and second side panels inward toward each other and overlapping each of the end flaps on the one end, and folding the end, flaps of the opposite end of the first and second side panels inward toward each other and overlapping each of the end flaps on the opposite end.

5. The packaging assembly of claim 2, wherein the center panel lies substantially parallel to the area of the base portion that receives the upper portion.

6. The packaging assembly of claim 5, wherein the one or more caps are formed by injection molding or vacuum molding.

7. The packaging assembly of claim 3, wherein the one or more caps include an upward panel and a base panel, the upward panel being located in a substantially parallel and overlying relationship with the end flaps of the center panel and the first side panel and second side panel.

8. The packaging assembly of claim 7, wherein the upward panel of the one or more caps includes a raised end edge for receiving the upper portion.

9. The packaging assembly of claim 8, wherein the upward panel of the one or more caps further includes one or more indentations for assisting in connecting or removing the one or more caps to or from the three-dimensional shape.

10. The packaging assembly of claim 1, wherein the scored plastic piece comprises an amorphous polyethylene terephthalate material.

11. The packaging assembly of claim 1, wherein the base portion has a substantially identical shape as the upper portion.

12. The packaging assembly of claim 1, wherein corners of one or more free ends of the upper portion are rounded.

13. The packaging assembly of claim 1, wherein corners of one or more free ends of the upper portion are sharp.

14. The packaging assembly of claim 13, wherein the scored plastic piece includes regions having creases, regions having slits, regions having perforations, or a combination thereof.

15. The packaging assembly of claim 14, wherein the perforations are located along a portion of a crease.

16. The packaging assembly of claim 1, wherein the upper portion comprises two or more scored plastic pieces.

17. The packaging assembly of claim 1, wherein the upper portion, the base portion, or both, further comprises one or more support features.

18. The packaging assembly of claim 17, wherein the one or more support features maintain side panels of the scored plastic piece in a generally orthogonal orientation relative to the base portion, maintain adjacent side panels of the scored plastic piece in a generally orthogonal orientation relative to each other, or both.

19. The packaging assembly of claim 1, wherein the upper portion comprises a translucent or transparent material and the base portion comprises an opaque material.

20. A packaging assembly comprising:

i. an upper portion comprising:

a. a scored plastic piece, the scored plastic piece can be assembled to form a three-dimensional shape having an open bottom;

b. one or more caps each located at an end of the three-dimensional shape;

wherein a structural integrity of the three-dimensional shape is maintained with the one or more caps;

wherein the upper portion is substantially free of any visible tucks, flaps, or, glue lines; and ii. a base portion;

wherein an area of the base portion is received into the open bottom of the three-dimensional shape to connect the upper portion and the base portion.

* * * * *